US009847031B2

(12) United States Patent
Agarwal et al.

(10) Patent No.: US 9,847,031 B2
(45) Date of Patent: Dec. 19, 2017

(54) GROUND BASED SYSTEM AND METHODS FOR PROVIDING MULTIPLE FLIGHTPLAN RE-PLAN SCENARIOS TO A PILOT DURING FLIGHT

(71) Applicant: HONEYWELL INTERNATIONAL INC., Morristown, NJ (US)

(72) Inventors: Anand Agarwal, Karnataka (IN); David Allen Brabham, Maple Valley, WA (US); Trip Redner, Kirkland, WA (US); SatyaBhaskar Payasam, Andhra Pradesh (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 200 days.

(21) Appl. No.: 14/800,953

(22) Filed: Jul. 16, 2015

(65) Prior Publication Data

US 2015/0317904 A1 Nov. 5, 2015

Related U.S. Application Data

(62) Division of application No. 13/786,751, filed on Mar. 6, 2013, now Pat. No. 9,117,368.

(51) Int. Cl.
*G08G 5/00* (2006.01)
*G08G 1/16* (2006.01)

(52) U.S. Cl.
CPC ..... *G08G 5/0039* (2013.01); *G08G 5/0013* (2013.01); *G08G 5/0021* (2013.01);
(Continued)

(58) Field of Classification Search
CPC .. G08G 5/0039; G08G 5/0021; G08G 5/0047; G08G 5/0091; G08G 5/006;
(Continued)

(56) References Cited

U.S. PATENT DOCUMENTS 6,161,063 A 12/2000 Deker
6,606,563 B2 8/2003 Corcoran, III
(Continued)

FOREIGN PATENT DOCUMENTS

CN 101533563 A 9/2009
EP 1079204 A1 2/2001
(Continued)

OTHER PUBLICATIONS

China Search Report for Application No. 201210434557.7 dated Jul. 30, 2015.
(Continued)

*Primary Examiner* — Mussa A Shaawat
(74) *Attorney, Agent, or Firm* — Lorenz & Kopf, LLP

(57) ABSTRACT

Methods and apparatus are provided for transmitting re-routing options to a plurality of in-flight aircraft in accordance with preconfigured pilot preferences. The apparatus comprises a data store module containing data sets against which the pilot preferences are evaluated during flight, including weather, airspace and flight restrictions, ground delay programs, and air traffic information. The apparatus further includes a flight path module containing route and position information for each aircraft. An incursion alert processing module evaluates the flight path, data store, and pilot preferences and generates incursion alerts which are transmitted to each aircraft during flight. Upon receipt of an incursion alert or, alternatively, independent of an incursion alert, the pilot may request re-routing options. Once received and reviewed, the pilot selects the optimum re-routing option, and an associated micro flight plan is uplinked and loaded into the FMS (Flight Management System).

18 Claims, 5 Drawing Sheets

(52) U.S. Cl.
CPC ..... *G08G 5/0026* (2013.01); *G08G 5/0047* (2013.01); *G08G 5/0082* (2013.01); *G08G 1/16* (2013.01); *G08G 5/006* (2013.01); *G08G 5/0091* (2013.01)

(58) Field of Classification Search
CPC .. G08G 5/0013; G08G 5/0026; G08G 5/0082; G08G 1/16
See application file for complete search history.

(56) References Cited

U.S. PATENT DOCUMENTS

| | | | | |
|---|---|---|---|---|
| 6,675,095 | B1 | 1/2004 | Bird et al. | |
| 6,683,541 | B2 | 1/2004 | Staggs et al. | |
| 7,081,834 | B2 | 7/2006 | Ruokangas et al. | |
| 7,194,353 | B1 * | 3/2007 | Baldwin | G01C 21/00 701/301 |
| 7,212,917 | B2 | 5/2007 | Wilson, Jr | |
| 7,271,740 | B2 | 9/2007 | Fischer | |
| 7,619,555 | B2 | 11/2009 | Rolfe | |
| RE41,271 | E | 4/2010 | Vaida | |
| 7,877,197 | B2 | 1/2011 | Lewis et al. | |
| 7,957,853 | B2 | 6/2011 | Stock et al. | |
| 8,072,374 | B2 | 12/2011 | Hovey | |
| 8,538,669 | B2 | 9/2013 | Agarwal et al. | |
| 8,843,303 | B1 * | 9/2014 | Young | G08G 5/0039 701/122 |
| 2002/0039070 | A1 | 4/2002 | Ververs et al. | |
| 2003/0055564 | A1 | 3/2003 | Tart et al. | |
| 2003/0169185 | A1 | 9/2003 | Taylor | |
| 2004/0183695 | A1 | 9/2004 | Ruokangas et al. | |
| 2005/0200501 | A1 | 9/2005 | Smith | |
| 2006/0293840 | A1 | 12/2006 | Klein | |
| 2008/0103645 | A1 | 5/2008 | DeMers et al. | |
| 2008/0183344 | A1 | 7/2008 | Doyen et al. | |
| 2008/0186222 | A1 | 8/2008 | Rolfe | |
| 2008/0195301 | A1 | 8/2008 | Fabre et al. | |
| 2009/0146875 | A1 * | 6/2009 | Hovey | G08G 5/04 342/357.31 |
| 2009/0322567 | A1 | 12/2009 | Stock et al. | |
| 2010/0109936 | A1 | 5/2010 | Levy | |
| 2010/0145552 | A1 * | 6/2010 | Herman | G08G 5/0034 701/3 |
| 2011/0118981 | A1 | 5/2011 | Chamlou | |
| 2011/0202206 | A1 | 8/2011 | Karthikeyan et al. | |
| 2012/0078448 | A1 | 3/2012 | Dorneich et al. | |
| 2012/0112950 | A1 | 5/2012 | Hovey | |
| 2013/0126679 | A1 * | 5/2013 | Estkowski | G08G 5/0013 244/190 |

FOREIGN PATENT DOCUMENTS

| | | | |
|---|---|---|---|
| EP | 1916503 | A2 | 4/2008 |
| EP | 2040137 | A1 | 3/2009 |
| EP | 2076826 | A2 | 7/2009 |
| EP | 2434469 | A2 | 3/2012 |

OTHER PUBLICATIONS

China Office Action for Application No. 201210434557.7 dated Sep. 2, 2015.
EP Examination for Application No. 12 183 226.5-1803 dated Jun. 2, 2017.
EP search report for EP 14157094.5-1803/2775470 dated Nov. 20, 2014.
EP search report for EP 12183226.5-1803/2568460 dated May 31, 2013.
EP examination for EP 12183226.5-1803 dated Jun. 24, 2013.
USPTO Office Action for U.S. Appl. No. 13/786,751 dated Dec. 29, 2014.
USPTO Notice of Allowance for U.S. Appl. No. 13/786,751 dated Apr. 28, 2015.
USPTO Office Action dated Oct. 25, 2012 for U.S. Appl. No. 13/228,760.
USPTO Notice of Allowance dated Mar. 5, 2013 for U.S. Appl. No. 13/228,760.
EP Partial Search Report for Application No. 14157094.5 dated Jul. 28, 2014.

* cited by examiner

GROUND BASED SYSTEM AND METHODS FOR PROVIDING MULTIPLE FLIGHTPLAN RE-PLAN SCENARIOS TO A PILOT DURING FLIGHT

CROSS-REFERENCE TO RELATED APPLICATION

This application is a divisional of U.S. patent application Ser. No. 13/786,751, filed on Mar. 6, 2013, and the relevant content of the above application is incorporated by reference herein. This application also relates to co-pending U.S. application Ser. No. 13/228,760 filed on Sep. 9, 2011, which issued as U.S. Pat. No. 8,538,669.

TECHNICAL FIELD

The present invention generally relates to ground based aircraft flight advisory systems, and more particularly relates to an automated module for providing re-routing options and corresponding micro flight plans to in-flight aircraft based on preconfigured pilot preferences.

BACKGROUND

The three phases of commercial flight include pre-flight, in-flight, and post-flight. During the pre-flight phase, the pilot and/or dispatcher reviews the preparation checklist and identifies any issues that could impact the aircraft during takeoff, landing, or cause problems in flight. These activities are part of the pre-flight phase and are advisory in nature.

In the in-flight phase, pilots primarily rely upon on-board systems and ground-based support for updated information regarding airspace information. Pilot requests for information from ground based systems are event based and at the pilot's discretion. In addition, dispatchers monitoring flights for airlines and corporate aircraft fleets may also send updates based on their tracking of the in-flight aircraft.

As the aircraft takes-off there are numerous possibilities of localized and unexpected situations along the flight-path. These changes might be caused due to one or all of the factors including weather, air and ground traffic, fuel level, winds, turbulence, electric/mechanical problems, airspace restrictions, and diversion to an alternate airport.

Presently known systems for in-flight re-planning and re-routing are limited in several respects. On-board systems are costly and typically have a limited range. Uplinked messages are event based and must be initiated by the pilot. Moreover, they generally relate to current position and do not have the ability to predict upcoming issues along the flight path.

Presently known flight operation systems are further limited in that ground based flight operation specialists can only monitor a certain number of aircraft at a time, for example in the range of 8-20 aircraft. They are labor intensive and thus costly, and are not easily scalable.

Additionally, based on pilot surveys it is believed that the most common conditions leading to heading changes are deviations around weather systems. Altitude changes are most commonly induced by unfavorable winds, icing, or turbulence. Air speed changes are typically initiated in response to turbulence or schedule adherence (i.e., the aircraft running ahead of or behind schedule).

Accordingly, it is desirable to provide in-flight re-routing options which overcome the foregoing limitations. Furthermore, other desirable features and characteristics of the present invention will become apparent from the subsequent detailed description of the invention and the appended claims, taken in conjunction with the accompanying drawings and this background of the invention.

BRIEF SUMMARY

Systems and methods are provided for providing a plurality of re-routing options and associated micro flight plans to a plurality of in-flight aircraft in accordance with preconfigured pilot preferences. The system includes a data store module containing data sets against which the pilot preferences are evaluated during flight, including weather, airspace and flight restrictions, ground delay programs, and air traffic information. The system further includes a flight path module containing route and position information for each aircraft, and an incursion alert processing module configured to evaluate the flight path information, data store, and pilot preferences and to generate incursion alerts and transmit them to the aircraft during flight. Once the pilot selects an optimum or desired one of the proposed re-routing options, a corresponding micro flight plan is uploaded directly into the on-board flight management system (FMS).

A method is provided for uplinking re-routing options to a plurality of aircraft during flight. The method involves configuring a set of pilot preferences for each aircraft during a pre-flight configuration phase, and applying the preconfigured sets to an incursion alert processing module. A data store of conditions impacting the aircraft during takeoff, landing, and in-flight is maintained, and the flight path for each aircraft is monitored. The flight path information and the data store are applied to the incursion alert processing module. The method further involves evaluating the sets of pilot preferences against the data store for each aircraft and its associated flight path, generating an incursion alert for each aircraft based on the evaluation, and transmitting incursion alerts to the various aircraft during flight. Once the re-routing options are evaluated by the pilot, the pilot selects a desired re-routing option, whereupon a corresponding micro flight plan is uploaded directly onto the on-board flight management system (FMS).

BRIEF DESCRIPTION OF THE DRAWINGS

The present invention will hereinafter be described in conjunction with the following drawing figures, wherein like numerals denote like elements.

DETAILED DESCRIPTION

Figure 1:
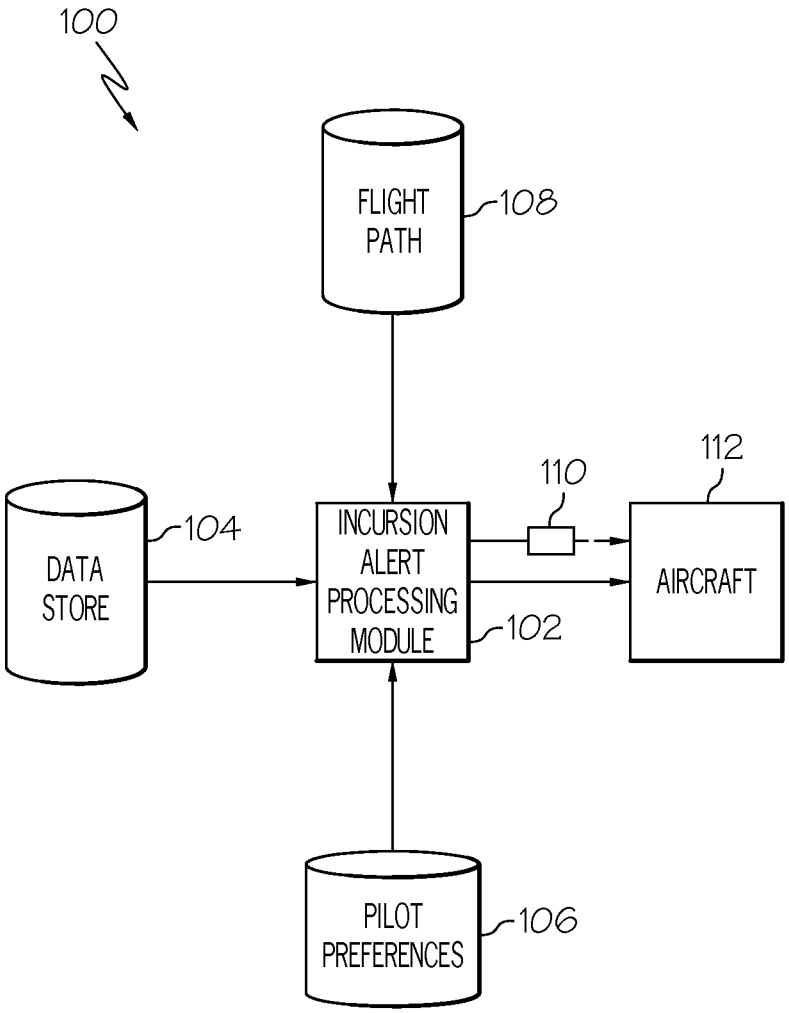
FIG. 1 is a block diagram of an exemplary incursion alert system in accordance with the subject matter described herein.

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Those of skill in the art will appreciate that the various illustrative logical blocks, modules, and algorithm steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions.

To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein.

A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. The word "exemplary" is used exclusively herein to mean "serving as an example, instance, or illustration." Any embodiment described herein as "exemplary" is not necessarily to be construed as preferred or advantageous over other embodiments.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

In one implementation of this embodiment, the monitored system is an aircraft. In another implementation of this embodiment, the monitored system is a land vehicle or water-based vehicle.

Referring now to FIG. 1, an incursion alert system 100 includes a data store 104, an incursion alert processing module (IAPM) 102, a flight path data module 108, and a pilot preferences module 106. Data store 104, flight path data module 108, and pilot preferences module 106 feed information to incursion alert processing module 102 which, in turn, generates an incursion alert 110 and transmits it to an aircraft 112. The incursion alert reports the existence of an event that might impact the aircraft, for example issues relating to safety, scheduling, delays, convenience, and the like. The alert may include text, graphics, or both.

Figure 2:
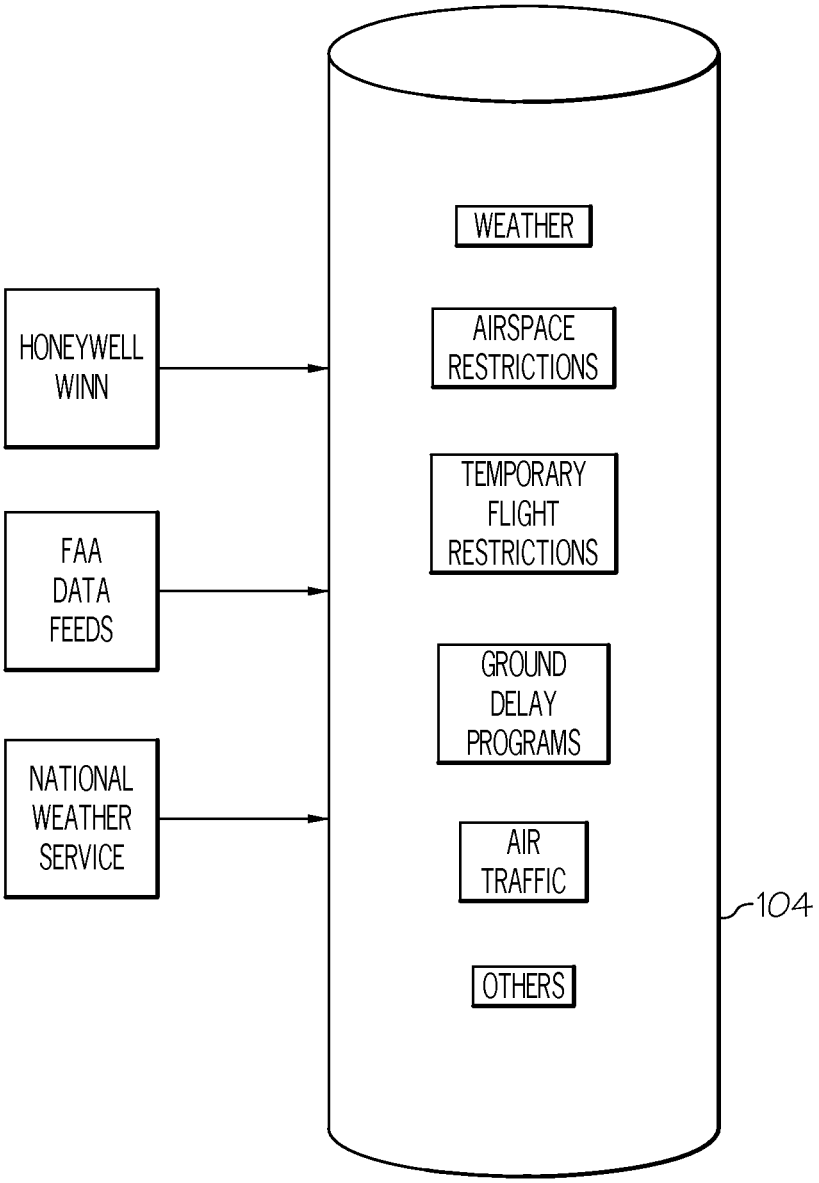
FIG. 2 is a block diagram of an exemplary data store module for use in connection with the incursion alert system of FIG. 1.

Data store 104 maintains data regarding various conditions that could affect the aircraft during take off, landing, and in flight. Referring now to FIG. 2, these data include, but are not limited to, information pertaining to weather, airspace restrictions, temporary flight restrictions, ground delay programs, air traffic, and other data. Data store 104 may be fed with data and information from various sources, including Federal Aviation Administration (FAA) Data Feeds, Honeywell's WINN product, the National Weather Service, and the like.

Figure 3:
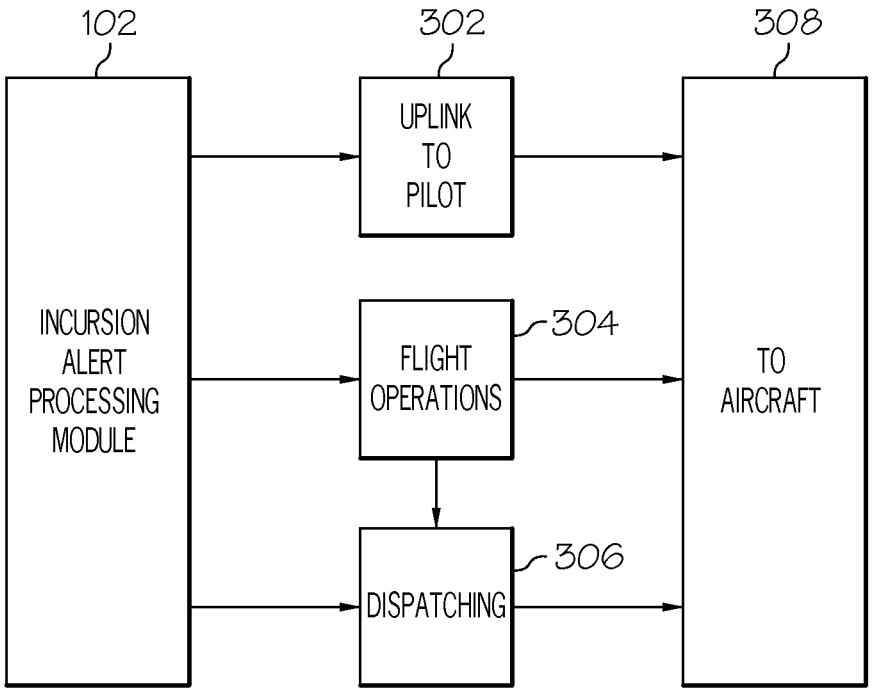
FIG. 3 is a block diagram illustrating various modes for transmitting incursion alerts to in-flight aircraft.

Referring now to FIG. 3, incursion alert processing module 102 generates incursion alerts and provides them to one or more aircraft 308. More particularly, the incursion alert may be provided as an uplink 302 to the pilot through a known datalink application. Alternatively, the incursion alert may be provided to ground-based flight operations personnel 304, who verify the assessment and/or other information contained in the incursion alert and forward the alert to the pilot. As a further alternative, the incursion alert may be provided to corporate or airline dispatchers 306 by the incursion alert processing module 102 or to operational personnel 304, who then forward the alert to the aircraft.

Figure 4:
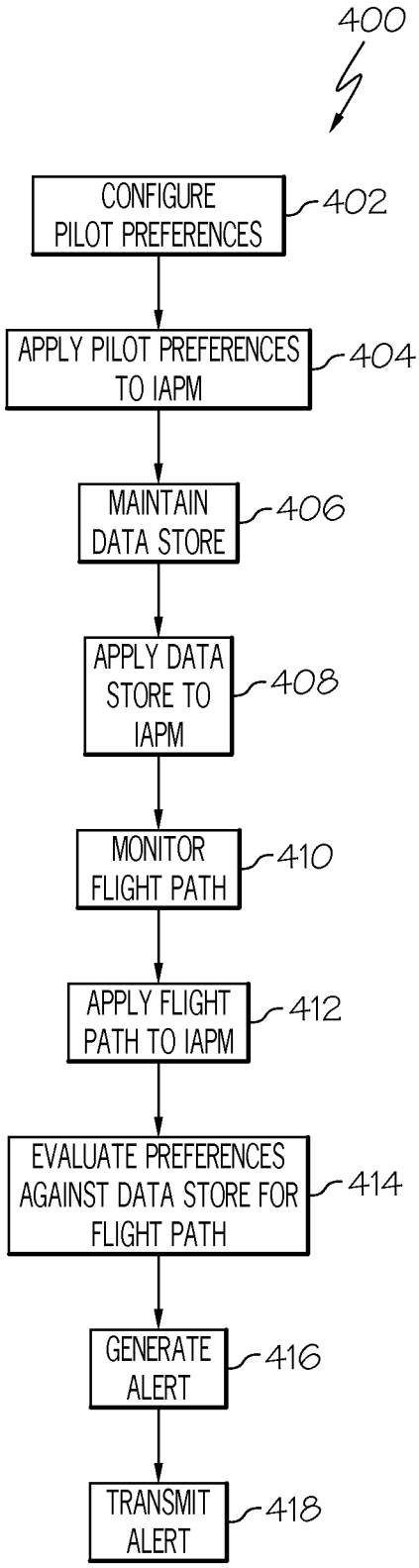
FIG. 4 is a flow chart diagram illustrating a method for generating incursion alerts and transmitting them to in-flight aircraft in accordance with an embodiment.

FIG. 4 is a flowchart setting forth an exemplary method 400 for generating incursion alerts and transmitting them to aircraft in accordance with an embodiment. In this regard, in view of the automated nature (e.g. computer implemented) of incursion alert processing module 102, system operators may safely monitor a greater number of aircraft, for example in the range of 200-500 or more.

Method 400 includes configuring a set of pilot preferences (task 402) for each aircraft. Pilot preferences relate to conditions and circumstances about which a pilot desires to receive an alert during flight, and may establish tolerance levels above which an alert is to be sent. Pilot preferences are configured during the pre-flight phase. In a preferred embodiment, pilot preferences are configured on line using a web-based interface.

The pre-configured pilot preferences are applied to incursion alert processing module 102 (task 404). This may be done iteratively or in a batch process. A data store is maintained (task 406) including information relating to conditions affecting or impacting the aircraft during takeoff, landing, and in flight. The data store is also fed to incursion alert processing module 102 (task 408), preferably providing real time updates.

With continued reference to FIG. 4, the system monitors the flight path, including route and position data, for each aircraft (task 410). The flight path data is also applied to incursion alert processing module 102 (task 412).

The system evaluates the set of pilot preferences against the data store for the aircraft and its associated flight path (task 414), and generates an incursion alert (as necessary) based on the ongoing evaluation (task 416). The incursion alert is then transmitted to the aircraft (task 418), as discussed above in connection with FIG. 3.

Figure 5:
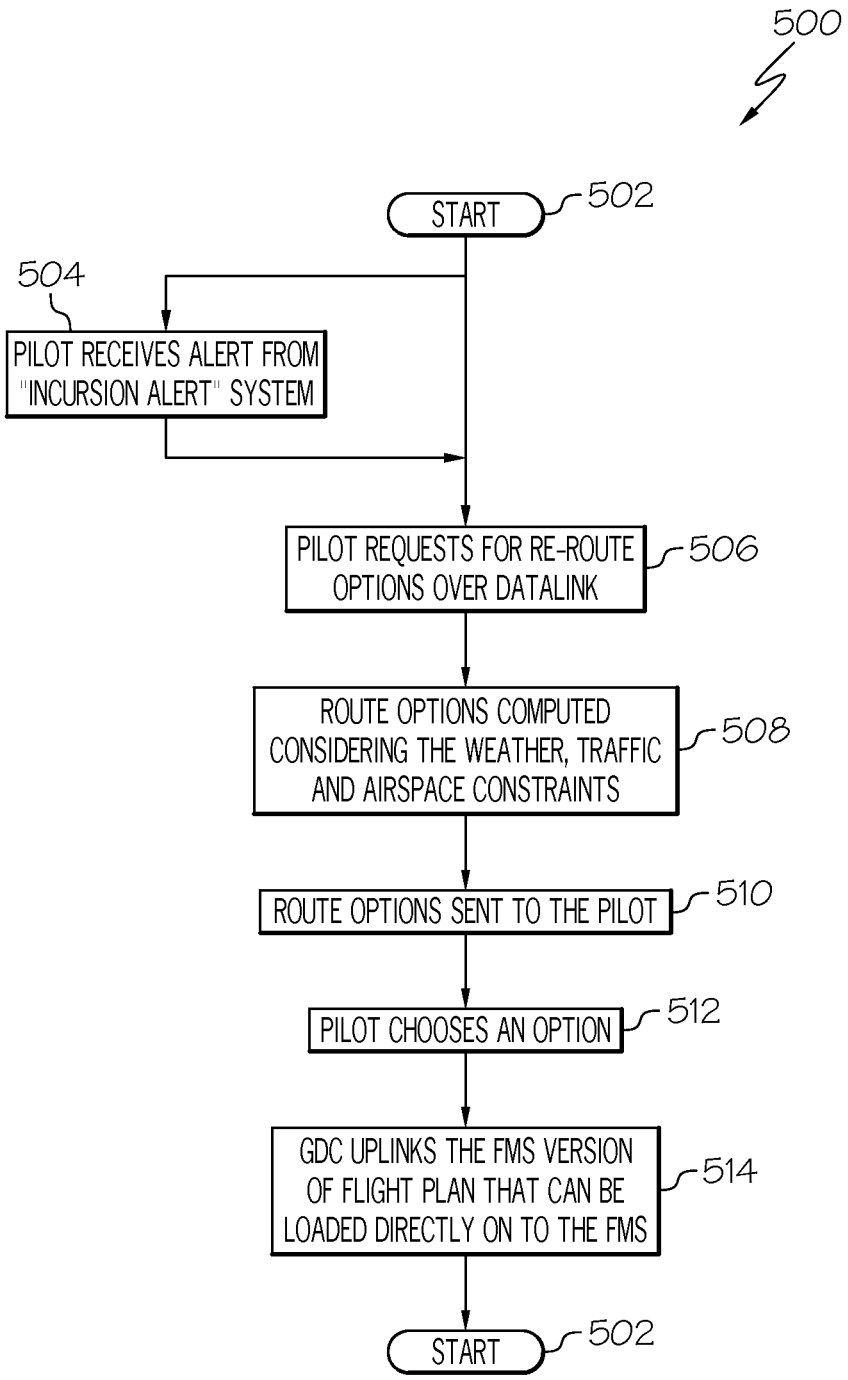
FIG. 5 is a flow chart diagram illustrating a method for generating re-planning options and transmitting them to in-flight aircraft in accordance with an embodiment.

FIG. 5 is a flowchart setting forth an exemplary method 500 for generating re-planning (re-routing) options and uplinking them to an aircraft via Datalink in accordance with an embodiment. Method 500 includes a steady state in-flight condition (Task 502) from which a pilot may request re-planning or re-routing options either upon receipt of an incursion alert (Task 504) or sua sponte (i.e., manually) (Task 506).

More particularly, Task 504 involves transmitting an incursion alert to the pilot (cockpit) as generally described above in connection with FIG. 4. Upon receipt of the incursion alert or, alternatively, independently of an incursion alert, the pilot may manually request that re-routing options be provided (Task 506). In either case, re-routing options are computed (Task 508) based on weather, traffic, airspace, and other constraints. In an embodiment, the number "N" of re-routing options may be a pilot configurable number such as, for example, three, four, five, or the like. Each re-routing option has an associated micro flight plan.

Once computed, the re-routing options are transmitted (Task 510) to the pilot, for example, using Datalink. The pilot reviews the options and selects (Task 512) the most desirable one. In some embodiments, one or more selected re-routing options may require approval from air traffic control (ATC) and/or an airline operation center (AOC), which, in turn, may require one or more iterations of the re-routing selection process. Upon selecting the optimum re-routing option, the ground based system uplinks the corresponding FMS (Flight Management System) version of the micro flight plan to the aircraft and the micro flight plan is loaded directly on to the FMS (Task 514). Alternatively, the pilot may manually enter the micro flight plan into the on-board FMS. The system then returns to the "start" condition (Task 502) and awaits another incursion alert or, alternatively, awaits another pilot request for re-planning.

In another embodiment, the pilot may also specify a set of bounds based on the latest information available to the pilot in-flight. The set of bounds defines parameters (e.g., altitude, speed, direction) for one or more flight segments which the pilot wishes to avoid. When so specified, the system uses the set of bounds in computing the re-routing options so that the proposed re-routing options avoid the "out of bounds" criteria specified by the pilot.

A method of re-routing an aircraft during flight includes the steps of determining the existence of an in-flight incursion requiring a work around; receiving a re-routing request from the aircraft; computing re-routing options based on at least two of weather, air and ground traffic, aircraft fuel level, wind speed and direction, turbulence, electrical and mechanical problems with the aircraft, airspace restrictions, and diversion; transmitting "N" number of re-routing options to the aircraft; selecting, by the pilot, a unique one of the re-routing options; and uplinking a micro flight plan corresponding to the selected re-routing option to an on-board flight management system (FMS).

In an embodiment, the step of transmitting the re-routing options involves uplinking the re-routing options to the aircraft via an avionics Datalink. In another embodiment, the step of computing re-routing options further comprises generating a corresponding micro flight plan for each re-routing option, wherein the number N is in the range of about 1-10, and preferably about 3.

In a further embodiment, the method involves negotiating at least one re-routing option with an external authority and generating additional re-routing options as a result of the negotiating.

Another embodiment involves specifying, by the pilot, a set of bounds, and wherein computing comprises computing the re-routing options based further on the specified set of bounds.

The method further involves, in response to selecting a unique one of the re-routing options, uplinking a corresponding micro flight plan to the aircraft and loading it into an on-board flight management system (FMS).

The method may also involve determining the existence of an in-flight incursion by automatically generating an incursion alert using an incursion alert module. Alternatively, the in-flight incursion may be based on a pilot request to alter one or more of air speed, direction, and altitude.

In another embodiment, the pilot request may be based on at least one of: i) a ground based message received by the aircraft; ii) an unexpected localized change in at least one of weather, traffic, fuel, wind, turbulence, aircraft electrical and mechanical problems, air space restrictions, diversion; and iii) pilot desire to change speed, heading, or altitude.

The method may also involve basing the incursion on schedule adherence.

A method is also provided for providing re-planning options to an aircraft during flight. The method includes configuring, using a processor, a set of pilot preferences for the aircraft during a pre-flight configuration phase; applying the set of pilot preferences to an incursion alert processing module; maintaining a data store of conditions impacting the aircraft during takeoff, landing, and in flight, wherein the data store of conditions includes conditions relating to weather, airspace restrictions, temporary flight restrictions, ground delay programs, and air traffic; applying the data store to the incursion alert processing module; monitoring a flight path for the aircraft during flight; applying route and position data to the incursion alert processing module; evaluating, by a processor, the set of pilot preferences and the flight path against the data store; generating an incursion alert based on said evaluation; transmitting the incursion alert to the aircraft during flight; generating a plurality of work around options based on the evaluation; and transmitting the work around options to the aircraft during flight.

The method further involves selecting one of the work around options and loading a micro flight plan into an on-board flight management system (FMS) corresponding to the selected option.

In an embodiment, the method further includes specifying a set of pilot bounds and generating the plurality of work around options based on the set of pilot bounds.

In an embodiment, the number of work around options is pilot configurable and is in the range of 3-5.

A system for transmitting re-routing options to a plurality of in-flight aircraft in accordance with preconfigured pilot preferences is also provided. The system includes a data store module containing data sets against which the pilot preferences are evaluated during flight, including weather, airspace and flight restrictions, ground delay programs, and air traffic information; a flight path module containing route and position information for each aircraft; an incursion alert processing module configured to evaluate the flight path, data store, and pilot preferences and to generate incursion alerts and to transmit at least one of them to each aircraft during flight; and a datalink configured to provide a plurality of re-routing options to each aircraft based on one of the incursion alerts.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of re-routing an aircraft during flight, comprising:

a processor configured for determining an existence of an in-flight incursion requiring a work around;

the processor configured for receiving a re-routing request from the aircraft;

the processor configured for computing re-routing options based on at least two of weather, air and ground traffic, aircraft fuel level, wind speed and direction, turbulence, electrical and mechanical problems with the aircraft, airspace restrictions, and diversion, the processor further configured for computing the re-routing options based on a set of pilot defined bounds associated with a pilot of the aircraft, and for generating the re-routing options such that the re-routing options are within the set of pilot defined bounds;

the processor configured for transmitting "N" number of the re-routing options to the aircraft;

the processor configured for receiving a selection, from the aircraft, of a unique one of the re-routing options; and the processor configured for uplinking a micro flight plan corresponding to the selected re-routing option to an on-board flight management system (FMS) of the aircraft.

2. The method of claim 1, wherein transmitting the re-routing options comprises that the processor is configured for uplinking the re-routing options to the aircraft via an avionics Datalink.

3. The method of claim 1, wherein computing re-routing options further comprises that the processor is configured for generating a corresponding micro flight plan for each re-routing option.

4. The method of claim 1, wherein N=1-10.

5. The method of claim 1, wherein N=3.

6. The method of claim 1, further comprising that the processor is configured for negotiating at least one re-routing option with an external authority.

7. The method of claim 6, further comprising that the processor is configured for generating additional re-routing options as a result of said negotiating.

8. The method of claim 1, wherein in response to receiving the selection of the unique one of the re-routing options, the processor is configured for unlinking a corresponding micro flight plan to the aircraft and for loading said micro flight plan into the on-board flight management system (FMS).

9. The method of claim 1, wherein determining the existence of the in-flight incursion comprises that the processor is configured for automatically generating an incursion alert based on the determination of the in-flight incursion requiring a work around.

10. The method of claim 1, wherein determining the existence of the in-flight incursion further comprises the processor that is configured for determining the existence of the in-flight incursion based on a pilot request.

11. The method of claim 10, wherein said pilot request comprises altering at least one of air speed, direction, and altitude.

12. The method of claim 10, wherein said pilot request is based on at least one of: i) a ground based message received by the aircraft; ii) an unexpected localized change in at least one of weather, traffic, fuel, wind, turbulence, aircraft electrical and mechanical problems, air space restrictions, diversion; and iii) pilot desire to change speed, heading, or altitude.

13. The method of claim 1, wherein the determining the in-flight incursion is based on schedule adherence.

14. A method of re-routing an aircraft during flight, comprising:

a processor configured for determining an in-flight incursion based on a flight path of said aircraft that requires a work around;

the processor configured for generating an incursion alert based on the determination;

the processor configured for receiving a re-routing request from said aircraft based on said incursion alert;

the processor configured for computing re-routing options based on at least two of weather, air and ground traffic, aircraft fuel level, wind speed and direction, turbulence, electrical and mechanical problems with the aircraft, airspace restrictions, and diversion, said re-routing options associated with the flight path of said aircraft, the processor further configured for computing the re-routing options based on a set of pilot defined bounds associated with a pilot of the aircraft, the set of pilot defined bounds including parameters for air speed, direction and altitude, and for generating the re-routing options such that the re-routing options are within the set of pilot defined bounds;

the processor configured for transmitting "N" number of the re-routing options to the aircraft;

the processor configured for receiving a selection, from the aircraft, of a unique one of the re-routing options; and the processor configured for unlinking a micro flight plan corresponding to the selected re-routing option to an on-board flight management system (FMS) and for loading said micro flight plan into said on-board flight management system (FMS) of said aircraft.

15. The method of claim 14, wherein computing the re-routing options further comprises that the processor is configured for generating a corresponding micro flight plan for each of the re-routing options.

16. The method of claim 14, wherein the processor is configured for determining the in-flight incursion based on a pilot request.

17. The method of claim 16, wherein said pilot request comprises altering at least one of the air speed, the direction, and the altitude.

18. The method of claim 14, wherein the determining the in-flight incursion is based on schedule adherence.

* * * * *